US008562488B2

(12) United States Patent
Alberts

(10) Patent No.: US 8,562,488 B2
(45) Date of Patent: Oct. 22, 2013

(54) SYSTEMS AND METHODS FOR IMPROVING MOTOR FUNCTION WITH ASSISTED EXERCISE

(75) Inventor: Jay L. Alberts, Chagrin Falls, OH (US)

(73) Assignee: The Cleveland Clinic Foundation, Cleveland, OH (US)

( * ) Notice: Subject to any disclaimer, the term of this patent is extended or adjusted under 35 U.S.C. 154(b) by 864 days.

(21) Appl. No.: 12/635,220

(22) Filed: Dec. 10, 2009

(65) Prior Publication Data

US 2011/0082397 A1 Apr. 7, 2011

Related U.S. Application Data

(60) Provisional application No. 61/248,515, filed on Oct. 5, 2009.

(51) Int. Cl.
*A63B 24/00* (2006.01)

(52) U.S. Cl.
USPC ..... 482/4; 482/1; 482/8; 482/9; 482/901

(58) Field of Classification Search
USPC ..... 482/1–9, 900–902
See application file for complete search history.

(56) References Cited

U.S. PATENT DOCUMENTS

| | | | |
|---|---|---|---|
| 3,735,754 | A | 5/1973 | Reed |
| 5,067,710 | A | 11/1991 | Watterson et al. |
| 6,666,831 | B1 | 12/2003 | Edgerton et al. |
| 6,689,075 | B2 | 2/2004 | West |
| 2006/0229164 | A1 | 10/2006 | Einav et al. |
| 2007/0027410 | A1 | 2/2007 | Cost |
| 2008/0234113 | A1 | 9/2008 | Einav |
| 2008/0294025 | A1 | 11/2008 | Dardik et al. |

FOREIGN PATENT DOCUMENTS

| | | |
|---|---|---|
| WO | 2009104190 | 8/2009 |

OTHER PUBLICATIONS

Poulton et al., "Treadmill training ameliorates dopamine loss but not behavioral deficits in hemi-Parkinsonian rats," Experimental Neurology, 193: 181-197 (2005).
Tillerson et al., "Exercise induces behavioral recovery and attenuates neurochemical deficits in rodent models of Parkinson's disease," Neuroscience, 119: 899-911 (2003).
Herman et al., Six weeks of intensive treadmill training improves gait and quality of life in patients with Parkinson's disease: a pilot study. Arch. Phys. Med. Rehabil., 88:1154-1158 (2007).
Pohl et al., "Immediate effects of speed-dependent treadmill training on gait parameters in early Parkinson's disease," Arch. Phys. Med. Rehabil., 84: 1760-1766 (2003).
Smidt et al., "Effectiveness of exercise therapy: A best-evidence summary of systematic reviews," Aust. J. Physiotherapy, 51:71-85 (2005).
DeLong MR, "Primate models of movement disorders of basal ganglia origin." Trends in Neuroscience, 13(7): 281-185 (1990).

(Continued)

*Primary Examiner* — Glenn Richman
(74) *Attorney, Agent, or Firm* — Tarolli, Sundheim, Covell & Tummino LLP

(57) ABSTRACT

One embodiment of the present invention includes a system and method for alleviating symptoms of a medical disorder of a patient by forced exercise. The system includes an exercise machine having movable portions that move in response to a first contribution by a patient and in response a second contribution by a motor. The system further includes at least one mechanical sensor and a control system programmed to alter the second contribution by the motor in response to the sensed data.

17 Claims, 10 Drawing Sheets

(56) References Cited

OTHER PUBLICATIONS

Playford ED et al., "Impaired activation of frontal areas during movement in Parkinson's disease: a PET study," Adv. Neurol., 60: 506-510 (1993).

Playford et al., "Impaired mesial frontal and putamen activation in Parkinson's disease: a positron emission tomography study," Ann. Neurol., 32(2): 151-161 (1992).

Eidelberg et al., "The metabolic topography of parkinsonism," Journal of Cerebral Blood Flow and Metabolism, 14: 783-801 (1994).

Miyai et al., "Long-term effect of body weight-supported treadmill training in Parkinson's disease: a randomized controlled trial," Arch Phys Med Rehabil, vol. 83, Oct. 2002,1370-1373.

Takahashi et al., "Robot-based hand motor therapy after stroke," Brain (2008) 131, 425-437.

Ridgel et al., "Forced, Not Voluntary, Exercise Improves Motor Function in Parkinson's Disease Patients," Neurorehabilitation and Neural Repair, vol. 23, No. 6, Jun. 18, 2009, 600-608.

Ridgel et al., "Forced exercise improves motor function in Parkinson's disease patients," Medicine & Science in Sports & Exercise, Poster, Gait and Movement Disorders Conference, May 29, 2008.

PCT/IB10/03086 International Search Report and Written Opinion mailed Apr. 6, 2011.

A Stationary Tandem Bicycle Was Used to Deliver the Forced-Exercise Treatment

Mean Change in UPDRS III Motor Scores Decreased Significantly After 8 weeks of Forced Exercise but Returned Toward Baseline After the Exercise Training Was Completed

Error bars = standard deviations
EOT = end of treatment; EOT + 4 = end of treatment plus 4 weeks Biomechanical Measures of Bimanual Dexterity Improved Significantly Following Forced-Exercise and These Improvements in Function Were Sustained Following Exercise Cessation (EOT + 4)

Error Bars = Standard Deviations
EOT = End of Treatment; EOT + 4 = End of Treatment Plus 4 Weeks
FE = Forced Exercise; VE = Voluntary Exercise Center of Pressure for all Dexterity Trials for Patients in the Forced (x) and Voluntary (o) Groups at Baseline, End of Treatment (EOT), and End of Treatment Plus 4 Weeks (EOT+4)

Note: Ellipses define the area of spread that encompasses 95% of the data.

SYSTEMS AND METHODS FOR IMPROVING MOTOR FUNCTION WITH ASSISTED EXERCISE

CROSS-REFERENCE TO RELATED APPLICATION

The present application claims priority to U.S. Provisional Application No. 61/248,515, filed on Oct. 5, 2009 and incorporated by reference herein in its entirety.

TECHNICAL FIELD

The present invention relates generally to systems and methods for medical treatment. In a specific embodiment, the present invention relates to systems and methods for improving motor function in patients suffering from a neurological disorder.

BACKGROUND

Neurological disorders, such as neuromotor and neurocognitive disorders including those that are degenerative in nature, can result in significant deterioration of a patient's quality of life. Most neurological disorders can be treated to some extent by medication. In the case of Parkinson's Disease (PD), although anti-parkinsonian medications may improve PD motor function, their effectiveness declines as the disease progresses and disabling dyskinesias often develop after prolonged $_L$-DOPA use. Moreover, many people prefer more natural alternatives to medication.

Some studies have been conducted in animals to determine if exercise can be beneficial in treating PD. (See e.g., Poulton et al., "Treadmill training ameliorates dopamine loss but not behavioral deficits in hemi-Parkinsonian rats," *Experimental Neurology,* 193: 181-197 (2005); and Tillerson et al., "Exercise induces behavioral recovery and attenuates neurochemical deficits in rodent models of Parkinson's disease," *Neuroscience,* 119: 899-911 (2003)). In fact, animal studies have shown that forced-exercise improves motor function and has neuroprotective qualities. Specifically, in a forced-exercise paradigm, in order to avoid a noxious stimuli, rodents that were injected with 6-hydroxydopamine (6-ODHA) to simulate PD, exercise on a motorized treadmill at a rate greater than their preferred exercise rate.

However, the promising results from animal forced-exercise studies have not been translated to human patients with PD. Different forms of exercise have been used with Parkinson's patients. For example, traditional mechanical therapy activities, performance of sports training, unsupported treadmill walking, partial body weight supported treadmill walking, or a combination of endurance exercise activities have been used to improve PD motor skills. (See e.g., Herman et al., "Six weeks of intensive treadmill training improves gait and quality of life in patients with Parkinson's disease: a pilot study. *Arch. Phys. Med. Rehabil.,* 88:1154-1158 (2007); and Pohl et al., "Immediate effects of speed-dependent treadmill training on gait parameters in early Parkinson's disease," *Arch. Phys. Med. Rehabil.,* 84: 1760-1766 (2003)). Nonetheless, a meta-analysis concluded that there was insufficient evidence to support the effectiveness of exercise therapy for Parkinson's patients. (See e.g., Smidt et al., "Effectiveness of exercise therapy: A best-evidence summary of systematic reviews," *Aust. J. Physiotherapy,* 51:71-85 (2005)).

In addition, the debilitating effects of PD and other neuromotor and neurocognitive disorders typically inhibit people from achieving the full benefits of exercise in treating their respective disorder. In fact, patients with PD produce slow and irregular movements that limit their ability to exercise at the relatively high rates that may be necessary to improve motor function. See e.g. DeLong M R, "Primate models of movement disorders of basal ganglia origin." *Trends in Neuroscience,* 13(7): 281-185 (1990); Playford E D et al., "Impaired activation of frontal areas during movement in Parkinson's disease: a PET study," *Adv. Neurol,* 60: 506-510 (1993); Playford et al., "Impaired mesial frontal and putamen activation in Parkinson's disease: a positron emission tomography study," *Ann. Neurol.,* 32(2): 151-161 (1992); and Eidelberg et al., "The metabolic topography of parkinsonism,"*Journal of Cerebral Blood Flow and Metabolism,* 14: 783-801 (1994)). Furthermore, at later stages of some neurological disorders, including PD, medication can be less effective, thus further impairing a patient's capability to exercise.

SUMMARY

One aspect of the present invention includes a system for improving motor function in a patient exhibiting abnormal motor function. The system includes an exercise machine having movable portions that move in response to a first contribution to movement of said movable portions provided by the patient. The system also includes a motor coupled to said exercise machine that provides a second contribution to said movement of said movable portions. The system also includes at least one mechanical sensor on the exercise machine that senses a mechanical parameter of the patient or the motor. The system further includes a control system coupled to the exercise machine that is coupled to the motor and the mechanical sensor, and is programmed to receive data from the mechanical sensor and alter the amount of the second contribution based on the data from the mechanical sensor. In a preferred embodiment, the mechanical sensor senses the speed or cadence of the patient; the torque generated by the patient; the torque generated by the motor; the power generated by the patient; or the power generated by the motor. In a preferred embodiment, this system augments the cadence of the patient during exercise. Because the patient actively contributes to movement of the movable portions of the exercise machine, this system augments, but does not replace, the voluntary efforts of the patient.

Another aspect of the present invention includes a method for improving motor function in a patient suffering from abnormal motor function, such as a neurological disorder. The method includes receiving a first contribution to movement of movable portions of an exercise machine from the patient and sensing data corresponding to mechanical parameters of the patient or exercise machine. The method further includes providing a second contribution to said movement of said movable portions of said exercise machine via a motor that is coupled to said exercise machine, computing a patient summary score based on the sensed data, comparing the patient summary score with a pre-set desired summary score range, and altering the second contribution based on the comparison of the scores. In a preferred embodiment, the mechanical parameter is speed or cadence of the patient; torque generated by the patient; torque generated by the motor; power generated by the patient; or power generated by the motor. In a preferred embodiment, the neurological disorder is a neuromotor or neurocognitive disorder.

DETAILED DESCRIPTION

Figure 1:
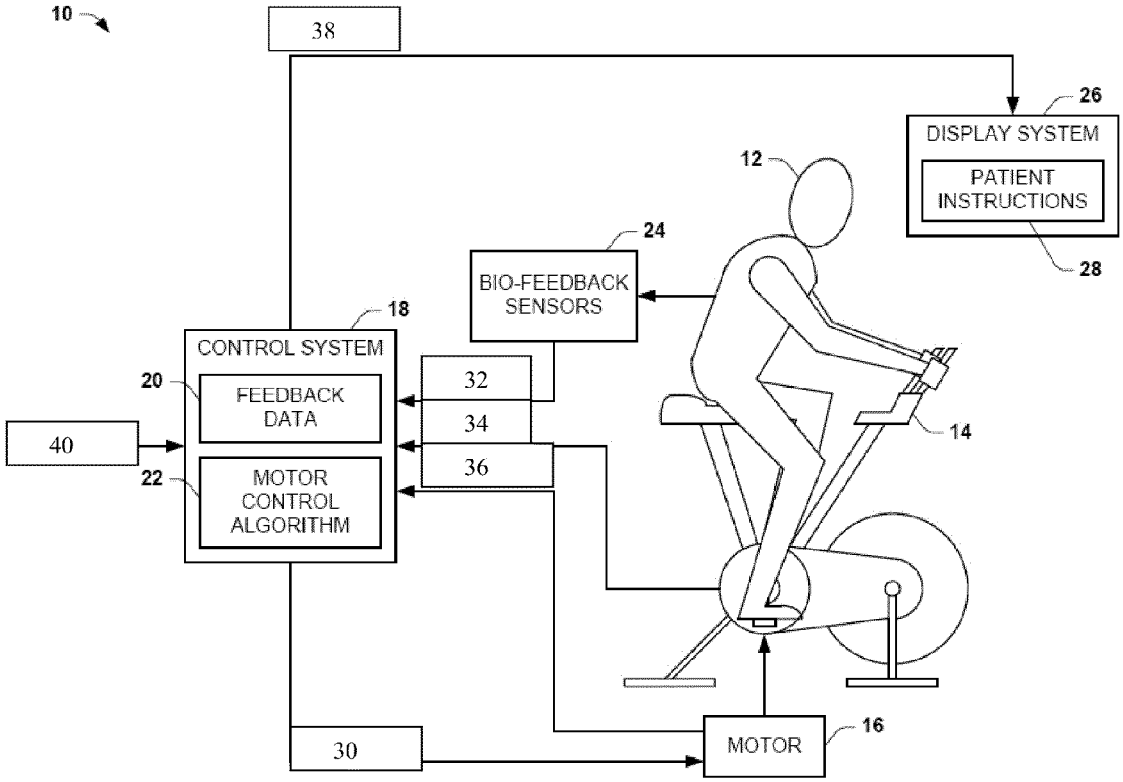
FIG. 1 illustrates an example of a system for improving motor function in a patient having abnormal motor function in accordance with an aspect of the invention.

In general, the present invention relates to forced exercise intervention as a method for improving symptoms in a patient suffering from a medical disorder. The medical disorder can be a neurological disorder such as a neuromotor or neurocognitive disorder as described in more detail below. In a particular embodiment, the present invention relates to forced exercise as a method for improving motor function in a patient suffering from abnormal motor function. The terms "forced exercise" or "forced aerobic exercise" generally refer to an exercise routine or program during which the patient is required to exercise at a predetermined exercise intensity range that is greater than the patient is willing or capable of performing.

In an exemplary embodiment, a patient with a medical disorder, such as a neurological disorder, and preferably a neuromotor or neurocognitive disorder, operates a motorized exercise machine. The system of the present invention monitors real-time feedback data of the patient and/or feedback data of the exercise machine via sensors during an exercise routine of the patient on the exercise machine. The sensors can measure mechanical or physiological parameters. An exemplary physiological parameter of the patient is heart rate. Exemplary mechanical parameters of the patient include cadence (such as pedaling rate), speed, torque, and power generated by the patient during the exercise. Exemplary mechanical parameters of the exercise machine include torque and power generated by the motor. Power and work are defined as follows:

$$\text{Power} = \frac{\text{work}}{\text{time}},$$

and Work=force×displacement.

Although the control system can be programmed to consider only one parameter, such as speed or cadence of the patient during performance on the exercise machine, the control system also can be programmed with an algorithm that combines a number of parameters to generate a patient summary score. The control system can output the patient summary score and instructions, such as to direct the patient to exercise faster or slower, to a display system, such as a computerized screen or a printout. As an example, the parameters of the physiological data and/or the mechanical data can be weighted to generate the patient summary score. Therefore, the patient can be provided with information necessary to exercise at a desired rate to receive the maximum clinical benefit for the alleviation of the symptoms of his or her medical disorder. Alternatively or in addition, the control system can be programmed to activate the motor to assist the patient in exercising at the desired rate to achieve the above-referenced benefits.

To implement the exercise system, the patient summary score can be compared with a pre-set desired score range. The patient can first be instructed to increase his or her speed, cadence, power or torque to maintain a level of exercise that is within the desired range. If the patient is unable to increase the speed, cadence, power or torque, then the control system is programmed to activate the motor to assist the patient in achieving a summary score within the desired range. Thus, the control system can control the magnitude of the assistance provided by the motor based on the patient's power, torque, cadence, or speed. As a result, the motor can provide more assistance when the control system detects that the patient needs additional assistance to maintain the summary score within the desired range, and can provide less assistance when the control system detects that the patient needs less assistance to maintain the summary score within the desired range. Accordingly, the patient is able to maintain exercise within the desired range to receive the maximum clinical benefit for the alleviation of the symptoms of the medical disorder.

FIG. 1 illustrates an example of a system 10 for alleviating symptoms of a medical disorder in accordance with an aspect of the invention. The system 10 illustrates a patient 12 exercising on an exercise machine 14. In the example of FIG. 1, the exercise machine 14 is demonstrated as a stationary exercise bicycle, however, it is to be understood that the exercise machine 14 can instead be any exercise machine that can receive a contribution of power from the patient (i.e. an active contribution) and a contribution of power from the motor of the machine, and has sensors and a control system. An exemplary exercise machine has movable parts that move in a periodic motion in response to movement by the patient. For example, the exercise machine 14 could be an upright stationary cycle, a recumbent stationary cycle, a semi-recumbent cycle, a stair-climbing machine, a cross-training machine, a treadmill (including body weight supported treadmills), a treadclimber, a cross-country skiing machine, an elliptical machine, a rowing machine, a motorized non-stationary bicycle, an arm ergometer, or any of a variety of other exercise machines. Thus, an exercise machine can require contribution of power from the patient's lower extremities, upper extremities, or both. As seen by Example 1, exercising the lower limbs results in improvements in motor function in the upper limbs and/or lower limbs. In certain embodiments, exercising the upper limbs results in improvements in motor function in the upper limbs and/or lower limbs. In certain embodiments, exercising the lower limbs results in improvements in motor function in the upper limbs.

The system 10 is implemented to provide forced exercise to the patient 12 for the alleviation of symptoms of the medical disorder(s) of the patient 12 by requiring the patient, as described above, to exercise at a predetermined exercise intensity range that is greater than the patient is willing or capable of performing without assistance. The intensity of the exercise movement may be measured in any suitable way. In some cases, the intensity may be measured as a cadence or speed. As used herein, "cadence" means the rate (e.g., per minute) of repetitions of the patient's limb movement while performing the exercise. The patient's limb movements are intended to be counted in the conventional fashion, which may vary according to the particular type of exercise or exercise machine being used. For example, on a stationary bicycle, the cadence may be the pedaling rate (e.g., pedal revolutions per minute or RPM); but on a treadmill or stair climber, the cadence may be the step rate (e.g., number of steps per minute). The intensity can also be measured as speed, for example in miles per hour.

In the case of cadence, to determine the voluntary intensity at which a patient is willing to exercise ("voluntary exercise"), a threshold cadence value can be determined by measuring the patient's maximum ability to exercise voluntarily, i.e. without assistance from another person or machine. To determine the intensity at which a patient is forced to exercise, a super-threshold cadence range can be determined, which is the desired range for treatment. The bottom of the super-threshold range is a value that exceeds a patient's threshold cadence value and results in an improvement in the patient's disease symptoms. The top of the super-threshold range is the value after which there is no further improvement in the patient's symptoms. A patient can achieve a cadence value that is within their super-threshold cadence range with assistance from a third party or machine. As stated above, the rate of exercise that is within the range of super-threshold cadence values is the rate at which the patient is forced to exercise.

To implement the forced exercise, the system 10 includes a motor 16 that is coupled to the exercise machine 14, such as coupled to the moving parts (e.g., the bicycle cranks coupled to the pedals). Therefore, the motor 16 can assist the motion of the movable parts of the exercise machine 14, such that the patient 12 can provide a first contribution to the movement of the movable parts and the motor 16 can provide a second contribution to the movement of the movable parts. The motor 16 can be controlled by a control system 18 that provides a signal 30 to the motor 16 that alters the speed of the motor 16. As demonstrated in greater detail below, the control system 18 can alter the speed of the motor 16 via the signal 30 in response to feedback data 20 from any one of a variety of sources.

To control the speed of the motor 16, the control system 18 is programmed to implement a motor control algorithm 22. Although the motor control algorithm 22 is demonstrated as a component of the control system 18 in the example of FIG. 1, it is to be understood that the motor control algorithm 22 can be stored on a computer-readable storage medium that is readable by a processor within the control system 18. The motor control algorithm 22 can be programmed to activate the motor 16, stop the motor 16, and/or control the speed of the motor 16 to maintain an exercise rate of the patient 12 that is within a desired range corresponding to alleviation of symptoms of the respective medical disorder, of the particular patient. Thus, to control the motor 16, the motor control algorithm 22 can be responsive to the first contribution to the movement of the movable parts of the exercise machine 14 provided by the patient 12, as well as to other factors associated with the motion of the exercise machine 14 and the patient 12. Any or all of these factors can contribute to the feedback data 20 that is collected by the control system 18 and which can be utilized by the motor control algorithm 22 for controlling the motor 16.

As an example, the feedback data 20 can include physiological data that is associated with aerobic exercise and/or physiological conditions of the patient 12. The system 10 thus includes bio-feedback sensors 24 that are coupled to the patient 12 and which provide the physiological data. As an example, the bio-feedback sensors 24 can include a heart-monitor to provide a heart-rate of the patient 12. It is to be understood that the bio-feedback sensors 24 could also include any of a variety of additional or alternative types of bio-feedback sensors, as well, such as a thermometer to measure body temperature, neurological impulse electrodes, and/or electrocardiogram (EKG) electrodes to provide other types of physiological data. Other physiological data sensed can include any measure of the patient's aerobic activity, such as respiratory rate, blood pressure, metabolic rate, caloric consumption rate, and respiratory $CO_2$ output, calories burned, and the symmetry of the pedaling. In the example of FIG. 1, the physiological data is transmitted from the bio-feedback sensors 24 to the control system 18 via a signal 32.

Other types of feedback can be generated in the system 10 to contribute to the feedback data 20. As an example, mechanical feedback associated with the exercise machine 14 can be provided to the control system 18, demonstrated in the example of FIG. 1 as a signal 34. For example, the exercise machine 14 can include a power meter coupled to the moving parts (e.g., the pedals) that measures an amount of power (in watts) that is provided by the patient 12, and thus measures the first contribution to the movement of the moving parts of the exercise machine 14. The feedback provided by the signal 34 can also include a cadence of the periodic motion of the moving parts of the exercise machine 14, such as a revolutions-per-minute (RPM) of the pedals of an exercise bicycle or the speed at which the patient is exercising. The cadence of the exercise machine 14 can be provided from the electronic controls of the exercise machine 14, or can be provided from an external sensor that can be coupled to the movable parts themselves. Furthermore, the motor 16 can provide feedback that is an indication of the power provided by the motor 16 itself. In the example of FIG. 1, the power feedback of the motor 16 is demonstrated as signal 36 that is provided to the control system 18 from the motor 16.

The motor control algorithm 22 can thus utilize the feedback data 20 to control the operation and/or speed of the motor 16 to provide a desired range of exercise for the patient 12. As an example, the desired rate of exercise can be specific to the patient 12 based on a variety of factors, such as the neurological disorder of the patient 12, the age and/or physiological health of the patient 12, the temporal stage of the exercise program for alleviation of the symptoms of the neurological disorder of the patient 12, or any of a variety of other factors. Therefore, the desired rate of exercise can change from one forced exercise session to another for a given patient 12. The desired rate of exercise can be provided to the control system as a predetermined desired summary score range, demonstrated as a signal 40, such as at the beginning of each of the forced exercise sessions. The motor control algorithm 22 can compile the feedback data 20 and compare it with the predetermined summary score range that is set by the signal 40 to determine the appropriate control and/or speed of the motor 16 to ensure that the patient 12 is exercising within the desired range for treatment. Thus, the motor control algorithm 22 can set the speed of the motor 16 to increase the second contribution of the movement of the moving parts of the exercise machine 14, such that the patient 12 is assisted in exercising at a rate that is greater than he or she is capable of performing alone.

The control system 18 can also be programmed to give the patient 12 an opportunity to attempt to exercise within the desired range with little assistance or no assistance from the motor 16. Specifically, the system 10 includes a display system 26 that can be configured as a computer monitor or a set of visual indicators that provide the patient 12 with an indication of his or her summary score. As an example, the display system 26 can display the feedback data 20, collectively or in individual components, and can display the desired range for a particular parameter, such as the cadence or power. Therefore, the patient 12 can attempt to adjust his or her exercise rate based on the visual indications.

In addition, the control system 18 can generate a signal 38 that provides patient instructions 28 via the display system 26 based on the comparison of the feedback data 20 with the predetermined desired summary score using the algorithm. As an example, the patient instructions 28 can instruct the patient 12 to increase his or her pedaling rate based on the feedback data 20 indicating that the patient 12 is exercising at less than the desired rate. Likewise, the patient instructions 28 can instruct the patient 12 to decrease his or her pedaling rate based on the feedback data 20 indicating that the patient 12 is exercising at greater than the desired rate. The control system 18 can thus provide the patient instructions 28 as a first attempt to encourage the patient 12 to exercise within the desired range. Subsequently, if the control system 18 determines that the patient 12 is unable to achieve a summary score that is within the desired range without assistance, such as based on failure of the patient 12 to meet a specific condition, the control system 18 may then invoke the motor control algorithm 22 to control the motor 16 to assist the patient 12 in achieving a summary score within the desired range.

The system 10 therefore is configured to allow the patient 12 having a medical disorder to benefit from forced exercise to substantially improve his or her respective condition. Specifically, the assisted exercise program allows the patient 12 an opportunity to substantially mitigate the effects of the medical condition, particularly for a patient 12 having a debilitating movement disorder that may be unable to achieve significant exercise without assistance. The assisted exercise may also provide a significant cardiac benefit for the patient 12, particularly for a patient 12 who is unable to achieve an aerobic exercise intensity that is sufficient for maintaining proper cardiac health on his or her own.

In certain embodiments, a system includes multiple exercise machines which are all in communication with a central monitoring station. The central monitoring station is equipped with computer system components for receiving and/or transmitting signals, processing data, and outputting data. For example, the central monitoring station may include one or more screen displays for viewing by the medical provider. This feature may be useful where the system is being used in a clinical facility by allowing the medical provider to monitor the performance of multiple patients simultaneously. In some cases, in addition to receiving data, the central monitoring system may also transmit control instructions to the individual exercise machines to provide forced exercise intervention in the manner described elsewhere herein. For example, the motor control algorithm may be performed at the central monitoring station. The communication link between the central monitoring station and the exercise machines may be provided in any suitable manner, including, for example, wireless communication.

Figure 2:
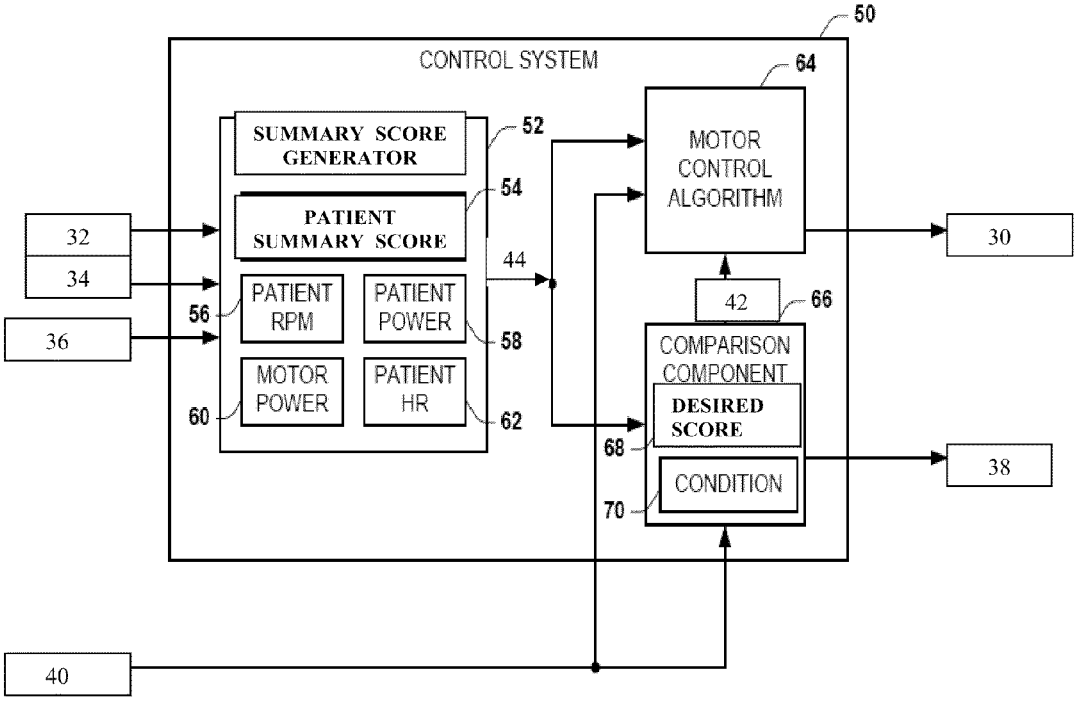
FIG. 2 illustrates an example of a control system in accordance with an aspect of the invention.

FIG. 2 illustrates an example of a control system 50 in accordance with an aspect of the invention. The control system 50 can be configured as a computer or computer system, or could be configured as a dedicated controller. As an example, the control system 50 can correspond to the control system 18 in the example of FIG. 1. Therefore, reference is to be made to the example of FIG. 1 in the following description of FIG. 2.

The control system 50 includes a summary score generator 52. The summary score generator 52 is configured to compile feedback data, such as the collective feedback data 20 in the example of FIG. 1, to generate a patient summary score 54 that is representative of the feedback data. As an example, the patient summary score 54 can be a single numerical value having weighted contributions from some or all of the sources of feedback data. In the example of FIG. 2, the summary score generator 52 is provided with the feedback signals 32, 34, and 36 from the bio-feedback sensors 24, the exercise machine 14, and the motor 16, respectively. Therefore, the summary score generator 52 receives the respective separate sources of feedback and generates the patient summary score 54 based on the collective feedback.

In the example of FIG. 2, the patient summary score comprises the intensity of the exercise movement (which may include both the voluntary and motor-assisted components), such as cadence 56 (in rpm), and further comprises the patient contribution to the exercise movement 58 (i.e., voluntary), the motor contribution to the exercise movement 60 (i.e., assisted), or both, and a physiologic parameter measured on the patient, such as heart-rate 62. It is noted that either the patient contribution, or the motor contribution, or both can be included in the summary score. A physiological parameter may or may not be included in the summary score.

The patient contribution and/or motor contribution to the exercise movement may be measured in any suitable way. For example, patient and/or motor contributions to the exercise movement can be measured as power, torque, cadence, or speed being applied by the patient or motor. As an example, the patient power 58 can be measured from a power meter that is coupled to the movable parts of the stationary exercise machine 14, and can be communicated to the feedback summary measure generator 52 from the signal 34. As an example, the motor power 60 can be measured from the motor 16 or an associated motor controller (not shown), and can be communicated to the summary score generator 52 from the signal 36.

Each factor in the summary score is given a certain weighting, which are set in such a manner as to give a summary score that can be used in an algorithm of the present invention to provide clinically beneficial treatments to patients. The weighting of the factors will also depend upon the units of measurement being used. However, the summary score used by the present invention is not intended to be limited to any particular unit measurement, but rather to encompass any scoring technique that uses alternate units of measurement, but would otherwise be equivalent to the scoring technique of the present invention when the appropriate unit conversions are made.

In some embodiments, the summary score may include two or more of the following factors: the cadence (revolutions per minute, including both the voluntary and forced components); the patient's power contribution (in watts); the motor's power contribution (in watts); and/or the patient's heart rate (beats per minute). In this summary score, the cadence may be given the greatest weight in the summary score, i.e., the cadence (in per minute units) is given a greater weight than the patient or motor power contributions (in watts) or the heart rate (beats per minute).

A specific, representative example of a summary score that can be used in the present invention is provided in the equation as follows:

$$\text{Summary_Score}=\Sigma A(\text{cadence})+B(\text{patient_power})+C(\text{motor_power})+D(\text{heart_rate})$$

where coefficient A is the weight contribution of the cadence, coefficient B is the weight contribution of the patient power, coefficient C is the weight contribution of the motor power, and coefficient D is the heart rate. In some cases, in the summary score above, coefficient A is greater than coefficients B, C, and D. In some cases, the weight contribution given to the patient's power is greater than the weight contribution given to the motor power, i.e., coefficient B is greater than coefficient C. In some cases, in the summary score above, coefficient D is lower than coefficients A, B and C. One particular weight distribution that is believed to be clinically useful is as follows: A=0.40, B=0.25, C=0.20, and D=0.15, but other weight distributions may also be useful.

Although the scoring technique described above is given in terms of particular units of measurement, any alternative scoring technique that uses different units of measurement, but would otherwise translate into the same scoring technique when the appropriate unit conversions are made, are intended to be encompassed by the present invention. Thus, for example, although an alternate scoring technique may use horsepower instead of watts as a measure of power, the horsepower can be converted to watts and the weighting coefficients adjusted accordingly to determine if the alternate scoring technique is encompassed by the present invention. In another example, although an alternate scoring technique may use pedal revolutions per hour instead of pedal revolutions per minute, the former can be converted to the latter and the weighting coefficients can be adjusted accordingly to determine if the alternate scoring technique is encompassed by the present invention.

Other factors that may be considered in the summary score include speed, torque generated by the machine, torque generated by the patient, average pedaling rate, pedaling symmetry, patient produced work, trainer produced work, total work produced, time in target heart rate zone, average cadence rate, time above or below average cadence rate, patient age, disease severity, number of exercise sessions attended, time since diagnosis, effective pedaling force, ineffective pedaling force, crank angle during maximum effective pedaling force, crank angle during ineffective pedaling force, pedaling symmetry, time cadence is less than 30% of unassisted rate, time cadence is more than 30% of unassisted rate, etc.

With respect to an exercise machine with pedals, preferred variables/parameters and the average values of these variables for PD patients and the values of these variables that results in improvement in PD patients (and thus are the desired values) are provided in the below table.

| Variable | Description of Variable | Average value/range of values for PD patient | Average desired values |
|---|---|---|---|
| Pedaling symmetry (for an exercise machine with pedals) | A percent measure of the amount of work in Kj produced by each limb during the pedaling action during exercise. | One limb (the limb with more compromised motor function) contributes 30% of the amount of work produced by the patient during the pedaling action during exercise (i.e. contributes less torque/force) and the other limb contributes 70% of the amount of work produced. | Each limb contributes 50% of the amount of work produced by the patient during the pedaling action during exercise. |
| Effective pedaling force | The resultant force that is applied perpendicular to the crank of the exercise machine. | 25 to 100 Newtons (N), dependent on the level of disease severity. | 200 to 350 N |
| Ineffective pedaling force | The resultant forced that is applied parallel to the crank. | 15 to 50 N dependent on level of disease severity. | 0 to 15 N |
| Crank angle during maximum effective pedaling force | The position within the pedaling cycle (crank angle) at which maximum effective pedaling force occurs. | 90 to 120 degrees | 85 to 95 degrees |
| Crank angle during ineffective pedaling force | The position within the pedaling cycle (crank angle) at which maximum ineffective pedaling force occurs. | 150 to 360 degrees | 220 to 230 degrees |
| Time cadence >30% of voluntary rate | The time the participant's pedaling rate is greater than 30% of the his/her voluntary self-selection pedaling rate. | 10-15% of the time | 70 to 85% of the time |

-continued

| Variable | Description of Variable | Average value/range of values for PD patient | Average desired values |
|---|---|---|---|
| Time cadence <30% of voluntary rate. | The time the participant's pedaling rate is less than 30% of his/her voluntary self-selection pedaling rate. | Greater than 30% | Less than 10% |
| Absolute time patient actively pedaling | The total time the participant spends actively contributing to the pedaling action of the cycle. | 70 to 85% of the time | Greater than 85% |
| Relative time patient actively pedaling | The percent of total exercise time that the participant is actively contributing to the pedaling action. | Less than 10% | Greater than 85% |
| Time within training heart rate zone | The total time in which the participant's heart rate is within 60-85% of their recommended heart rate for aerobic exercise using the Karvonen Formula. | 65% to 85% (based on a 23 year old with a resting heart rate of 65 bpm | 70-85% of the time |
| Blood Pressure | The pressure exerted by circulating blood on the walls of blood vessels, and is one or the principal vital signs. During each heartbeat, BP varies between a maximum (systolic) and a minimum (diastolic) pressure. | 120/80 | 132/90 |

The patient summary score 54 is provided via a signal 44 to a motor control algorithm 64 and a comparison component 66. As an example, the motor control algorithm 64 can correspond to the motor control algorithm 22 described above in the example of FIG. 1. Both the motor control algorithm 64 and the comparison component 66 can be stored on a computer-readable storage medium that can be read by a processor of the control system 50. The comparison component 66 also receives the predetermined desired summary score range 68 via the signal 40 that is representative of the desired range of exercise. In the example of FIG. 2, the predetermined desired summary score 68 is demonstrated as provided to the control system 50 via the signal 40. The patient summary score 54 can be compared directly with predetermined desired summary score range 68 by the comparison component 66 to determine if the patient 12 is within the desired range of exercise or the difference between the exercise of the patient 12 relative to the desired range. Thus, the comparison component 66 can generate the signal 38 that provides the patient instructions 28 to the patient 12 via the display system 26.

The comparison component 66 can also be programmed with one or more conditions 70 associated with activation of the motor control algorithm 64 based on failure of the patient 12 to achieve the desired range. For example, upon the patient instructions 28 instructing the patient 12 to pedal faster, the comparison component 66 can check the condition 70 to determine if the patient 12 has achieved the goal provided by the patient instructions 28 sufficiently. For example, the condition 70 can be a timer that can begin timing upon the patient instructions 28 being provided to instruct the patient 12. Upon the timer achieving a predetermined time without the patient 12 achieving the desired rate, as determined by the comparison component 66, the comparison component 66 ascertains that the patient 12 is unable to achieve an exercise intensity that is within the desired range without assistance. The comparison component 66 can thus provide an activation signal 42 to the motor control algorithm 64 to instruct the motor control algorithm 64 to activate the motor 16 and to control the speed of the motor 16 to force the patient 12 to achieve a desired rate of exercise. It is to be understood that the condition 70 is not limited to a timer, but can be any of a variety of other controls or stimuli that indicate that the patient 12 is unable to achieve a desired rate of exercise without assistance, such measurement of a rate of increase of exercise intensity, direct input by exercise technicians, direct input by the patient 12, or any of a variety of other controls and/or stimuli.

The motor control algorithm 64, upon receiving the activation signal 42, is configured to generate the signal 30 to activate and/or control the speed of the motor 16 to provide a second contribution of movement of the movable parts of the stationary exercise machine 14. In the example of FIG. 2, the signal 42 can also include information regarding the comparison of the patient summary score 54 with the predetermined desired summary score 68 to the motor control algorithm 64. Therefore, the motor control algorithm 64 can control the speed of the motor 16 based on a difference between the patient summary score 54 and the predetermined desired summary score 68. As an example, the motor control algorithm 64 can increase the speed of the motor 16 in response to the patient summary score 54 being less than the desired summary score range 68. Similarly, the motor control algorithm 64 can decrease the speed of the motor 16 in response to the patient summary score 54 being greater than the desired summary score range 68. Furthermore, the motor control algorithm 64 can set the speed of the motor 16 proportional to the difference between the patient summary score 54 and the predetermined desired summary score range 68, such that a smaller difference can result in a lower speed of the motor 16 to provide less of the second contribution to the movement of the movable parts of the exercise machine 14.

It is to be understood that the control system 50 is not limited to the example of FIG. 2. As an example, the motor control algorithm 64 and the comparison component 66 are demonstrated conceptually, such as based on being stored on a computer-readable storage medium, and are thus not limited to being configured separately. In addition, the summary score generator 52 is not limited to feedback based only on the patient RPM 56, the patient power 58, the motor power 60, and the patient heart-rate 62, but can include alternative or additional sources of feedback data in generating the patient summary score 54. Therefore, the control system 50 can be configured in any of a variety of ways.

Figure 3:
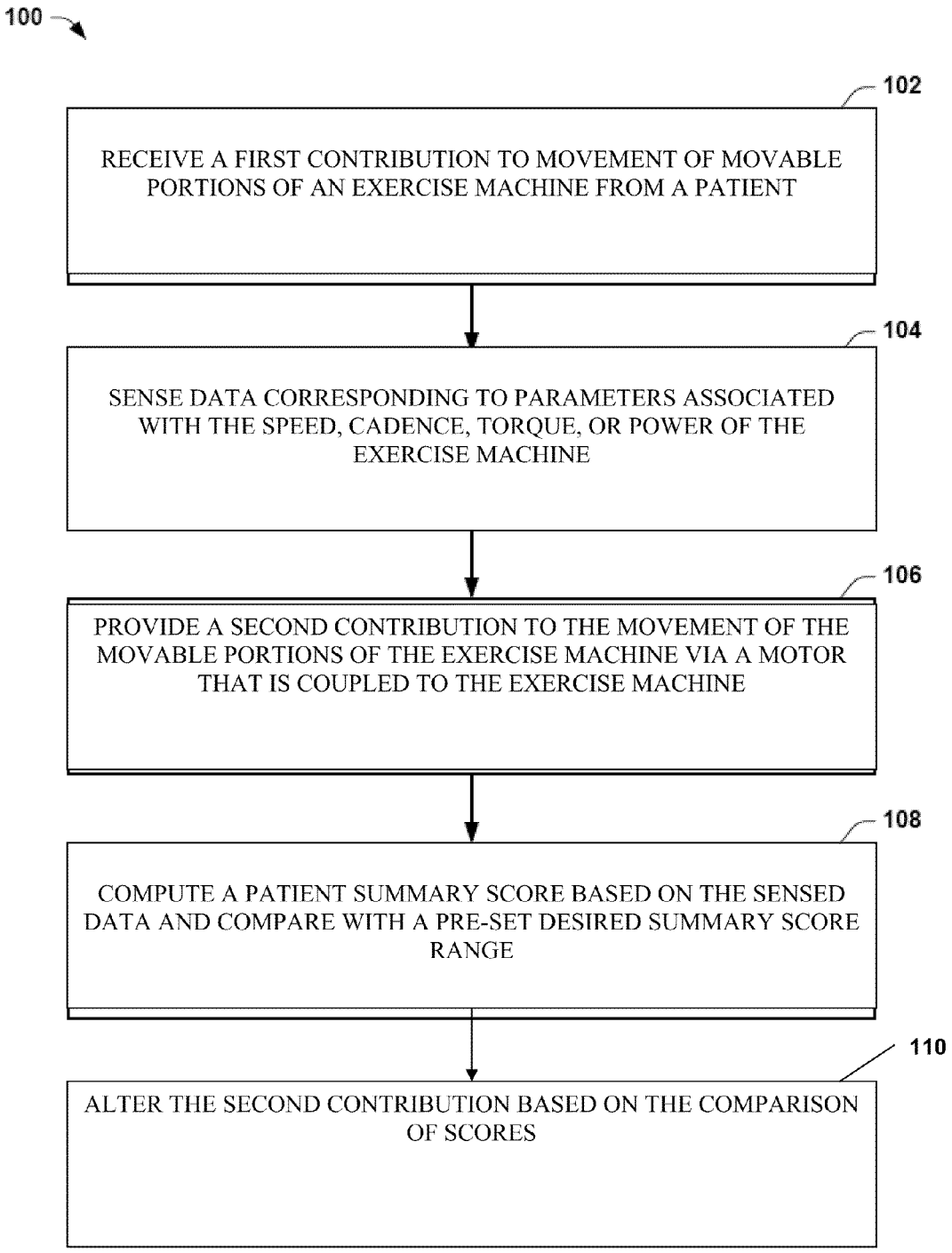
FIG. 3 illustrates an example of a method for improving motor function in a patient suffering from abnormal motor function in accordance with an aspect of the invention.

In view of the foregoing structural and functional features described above, a methodology in accordance with various aspects of the present invention will be better appreciated with reference to FIG. 3. While, for purposes of simplicity of explanation, the methodologies of FIG. 3 are shown and described as executing serially, it is to be understood and appreciated that the present invention is not limited by the illustrated order, as some aspects could, in accordance with the present invention, occur in different orders and/or concurrently with other aspects from that shown and described herein. Moreover, not all illustrated features may be required to implement a methodology in accordance with an aspect of the present invention.

FIG. 3 illustrates an example of a method 100 for treating a medical disorder. At 102, a first contribution to movement of movable portions of an exercise machine is received from a patient. The exercise machine can be a stationary exercise bicycle, such that the first contribution to the movement can be pedaling via the patient's legs. At 104, feedback data corresponding to parameters associated with at least one of the patient and the stationary exercise machine is sensed.

At 106, a second contribution to the movement of the movable portions of the exercise machine is provided via a motor coupled to the exercise machine. At 108, the feedback data can be used to compute a patient summary score that includes weighted portions of separate contributions to the feedback. As an example, the feedback data can include weighted portions of a patient's voluntary cadence of the movement, such as a pedaling RPM, the patient's power, the power of a motor, and bio-feedback data, such as the patient's heart rate. The patient summary score is then compared with a preset desired summary score range.

At 110, the second contribution is altered in response to the comparison. The motor can be controlled by a motor control algorithm that sets the speed of the motor based on the difference between the patient summary score and the preset desired summary score. As described above, a control system can first provide the patient with instructions and, upon the patient being unable to comply with the instructions, may invoke the motor control algorithm to activate the motor to assist the patient to assist the patient to exercise within the desired range.

The factors to be included in the summary score, how the factors are weighted, and/or how the summary score is used in the motor control algorithm can be determined using any suitable clinical trial methodology. In order to determine the desired summary score range, clinical trials are performed on different patient populations. Each of the factors in the algorithm, such as heart rate, patient power, machine power, and cadence, may be varied based on the amount of variance each factor explains in terms of the overall effectiveness of reducing the motor or neurocognitive symptoms.

One such clinical trial methodology that can be used is as follows. A group of patients having a particular medical condition are randomized to a voluntary, forced, or no-exercise control group. Patients in both exercise groups participate in a supervised exercise protocol for a specific period of time. The exercise is performed on an exercise machine, such as, for example, a motor-assisted stationary exercise bicycle. Patients in the voluntary group pedal the cycle at their self-selected voluntary pedaling rate. Patients in the forced-exercise group exercise on the same type of stationary cycle, but a motor provides assistance to the patient in order to maintain a pedaling rate greater than their preferred voluntary rate (for example, the patients in the forced exercise group could be assisted in maintaining a pedaling rate 35% greater than their preferred voluntary rate). Patients in the no exercise control group do not participate in any formal exercise intervention. All three groups complete various tests to assess their conditions at different time points such as baseline, mid-treatment, end of treatment, and different time periods after the end of treatment.

The effects of forced and voluntary exercise in improving the symptoms of the patients can be determined by changes in standard examination scores for the particular disease of the patients or other measures well known in the art for the particular disease state. Each of the factors in the algorithm, such as heart rate, patient power, machine power, and cadence, are weighted according to their ability to explain the total variance in the effectiveness of the treatment. For each patient population, a particular clinical test is then conducted to determine how the exercise has affected their disease. For patients suffering from dystonia, the following scales can be used: Barry-Albright Dystonia (BAD) Scale, Fahn-Marsden Scale (F-M), Unified Dystonia Rating Scale (UDRS), and Global Dystonia Rating Scale (GDS). For patients suffering from Alzheimer's, the following scales can be used: Alzheimer's Disease Assessment Scale (ADAS) and Hierarchic Dementia Scale. For patients suffering from stroke, the following scales can be used: Fugl-Meyer scale, Rivermead Motor Assessment (RMA), Functional Independence Measure (FM), and the Barthel Index. For patients suffering from multiple sclerosis, the following scales can be used: Kurtzke Expanded Disability Status Scale, Multiple Sclerosis Impact Scale (MSIS-29), Impact of Multiple Sclerosis Scale (IMSS), and Symptoms of Multiple Sclerosis Scale (SMSS). For patients suffering from Parkinson's Disease, the following scales can be used: Unified Parkinson's Disease Rating Scale (UPDRS), and Schwab and England Activities of Daily Living.

The motor-assisted cycle used by each patient has a DC motor with a drive system that is capable of reporting how much torque the motor is applying to the bicycle. To overcome friction at a given velocity, the motor must apply some amount of torque ($T_{baseline}$). This baseline torque is subtracted from measurements taken with a patient. Instantaneous power, in watts, generated by the patient becomes $(T_{measured}-T_{baseline})\times$cadence. Another feature allows a "torque limit" to be set. The torque limit refers to how much force the motor is allowed to exert to maintain its commanded velocity. If the torque limit is exceeded, the motor can be overdriven. Once overdriven, the motor applies a constant torque of the torque limit setting.

For the voluntary protocol, the motor is set to a cadence of zero RPM and the torque limit is also set to zero; thus no assistance is provided to the patient. The patient pedals at their preferred rates and adjust resistance as necessary to maintain their prescribed heart rate. For the forced protocol, the motor is commanded to the appropriate pedaling rate for each patient and the torque limit is set at the maximum level to prevent patient overdriving and to ensure that the programmed pedaling rate is maintained. The patient's voluntary pedaling rate is determined from initial cardiopulmonary exercise testing of the patients described in more detail below. The patient's contribution of work to the pedaling action is determined by the difference between $T_{measured}$ and $T_{baseline}$ at the prescribed cadence.

Training heart rate $(T)_{HR}$) zone for each subject can be determined using the Karvonen formula at the 60-80% range, calculated as follows ($HR_{max}$ is maximum heart rate, $HR_{rest}$ is resting heart rate): $T_{HR}=((HR_{max}-HR_{rest})\times\%\ \text{Intensity})+HR_{rest}$. Each patient is instructed to exercise within 60-80% of their $T_{HR}$ during the exercise set and the patient can be conditioned to spend more time on the exercise machine without rest as the trial progresses. Patients in the voluntary exercise group are instructed to maintain heart rate within their individualized $T_{HR}$ zone. For example, their current heart rate can be displayed relative to their $T_{HR}$ zone via a display screen mounted on the bicycle. No instructions are given regarding the maintenance of a particular cadence. Cadence and resistance level are voluntarily selected by the patient. The exercise supervisor ensures the patient maintains heart rate within $T_{HR}$ during the main exercise set.

Patients in the forced-exercise group have the pedaling rate set at greater than their preferred pedaling rate, which will be determined from their maximum aerobic capacity during the preliminary cardiopulmonary exercise testing session. The patient's current heart rate can be displayed relative to their $T_{HR}$ zone via a display screen mounted on the bicycle. Patients are instructed to maintain their heart rate within their individualized $T_{HR}$ zone through active pedaling of the cycle. Patients adjust (increase or decrease) their contribution to the pedaling action in order to maintain their heart rate within the target zone. Active pedaling involves overcoming the resistance provided by the cycle (i.e., combination of mechanical friction and programmed resistance of the cycle). The resistance to pedaling can be increased or decreased by the patient or exercise supervisor. Resistance is increased if the patient's heart rate is lower than their $T_{HR}$ zone and decreased if heart rate exceeds $T_{HR}$, while pedaling rate will be maintained.

The forced-exercise, voluntary exercise, and no-exercise randomized groups are compared descriptively on potentially confounding baseline variables (namely, age, disease severity, and medication equivalent daily dose) to assess the extent of any imbalance across groups. Baseline variables in which there appears to be a clinically important baseline difference, or in which the standardized difference (absolute value of difference in means divided by pooled standard deviation) between any 2 groups is greater than 10% are included as co-variables in all analyses.

The forced and voluntary exercise and the no-exercise control groups are compared on each outcome of interest using repeated measures analysis of covariance. Groups are compared on outcomes at the different points in time as described above, adjusting for the baseline period as a covariate. The effects of group, time, and the group-by-time interaction are assessed for each outcome. In the case of a significant interaction, the groups are compared at each time point. Tukey's correction for multiple comparisons can be used. Data can be transformed, as needed, to meet model assumptions. In addition to p-values, the estimated treatment effect and its 95% confidence interval can be of interest as these data will aid in formulating exercise recommendations and potential benefits. Significance level can be set at 0.05. Individual subject and correlation analysis can be performed between assessment scores and primary biomechanical variables at each time point where data are available. The results of this correlation analysis can be used to determine the weighting of the factors in the representative example of a summary score equation described above. Each patient's change in fitness based on change in peak aerobic capacity and cardiopulmonary exercise testing can be used as a covariant. This can remove the effect of possible differences in improvement in fitness level across the groups from confounding the results. The correlation between medication equivalent daily dose (MEDD) and the time spent within target heart rate zone during training, amount of work performed and change in primary outcome variables can also be assessed. If the MEDD is significantly correlated with these outcomes, this can be included as a o-variable in the related analysis.

Regarding the preliminary cardiopulmonary exercise testing referred to above, prior to randomization, all patients satisfying initial screening criteria for participation undergo cardiopulmonary exercise (CPX) testing on a semi-recumbent cycle ergometer, similar to the cycle used for training, and a commercially available MedGraphics $CardiO_2$/CP system with Breeze software. Testing is conducted while the patient is 'on' all medications as normally prescribed. Patients will be tested 2-4 hours post-prandial (i.e., after eating).

Expired gases are continuously monitored for $O_2$ and $CO_2$ concentrations as well as tidal volume and respiratory rate from pre-exercise rest to peak exercise using the MedGraphics system. A 12-lead electrocardiogram is assessed prior to exercise and monitored continuously throughout exercise and recovery. Blood pressure is monitored by auscultation at rest, during the last minute of each exercise stage and during recovery. Borg Rating of Perceived Exertion (RPE) is recorded at each stage and the patient will be monitored for signs/symptoms of exertion intolerance.

A continuous incremental protocol starting at 25 watts (W) and increasing in 10 W stages every two minutes is employed. Subjects are encouraged to continue to exercise to the point of volitional fatigue, failure to maintain cycle cadence of greater than 50 rpm, or onset of test termination criteria as described in the ACSM Guidelines for Exercise Testing and Prescription. The CPX test terminates when any one of these criteria is met. If the initial CPX test is terminated due to hemodynamic instability, arrhythmias, or ischemic signs/symptoms, the patient is excluded from the study.

Peak $VO_2$ (ventilatory oxygen uptake) is determined for each study as the highest 30 second average of $VO_2$ during the CPX test. Respiratory exchange ratio (RER) is also determined at the highest 30 second average for $VO_2$. The RER is utilized as an indicator of physiological effort. RER's greater than 1.1 are suggestive of a peak physiological effort. If a patient terminates a study prior to achieving an RER greater than 1.1, the data is included in the initial analysis but paired pre-to-post RER's are compared to identify any significant variation that may occur as a result of training. Within five days of completing their final exercise session of the eight week intervention or control period, patients repeat the fitness testing protocol.

The methods and systems of the present invention can be used by patients suffering from medical disorders. In preferred embodiments, the medical disorders are characterized by abnormal motor function, such as abnormal motor function in the patient's limbs (upper and/or lower extremities). The medical disorder can be a neurological disorder (i.e. a disorder of the patient's nervous system). In certain embodiments, the neurological disorder is a neuromotor or neurocognitive disorder that results in abnormal motor function and that is characterized by either irregular motor cortical output including, for example, output from the cerebellum and/or supplementary motor area ("SMA") of the cortex; irregular sub-cortical output from regions that contribute to motor function in a patient such as, for example, the basal ganglia, the subthalamic nucleus and/or the thalamus; diminished quantities of certain neurotrophic factors that are known to contribute to motor function such as Brain derived neurotrophic factor (BDNF) or Glial cell-derived neurotrophic factor (GDNF); and/or diminished quantities of certain neurons or neurotransmitters that are known to contribute to motor function such as dopamine and dopaminergic neurons.

As seen from Example 2, forced exercise results in activation of cortical and sub-cortical areas of the brain responsible for motor function and thus supports the methods of the present invention being used for different types of neuromotor and neurocognitive disorders characterized by abnormal motor function such as Alzheimer's Disease, dystonia, MS, ALS, dementia, Parkinsonian syndrome, trauma-induced brain injury, stroke and multiple systems atrophy (MSA).

In certain other embodiments, the methods and systems of the present invention are used to increase endogenous levels of certain neurotrophic factors such as BDNF and can be used to treat patients with diminished quantities of these neurotrophic factors. For example, declines in BDNF can trigger overeating and obesity and therefore methods and systems of the present invention can be used to decrease overeating in obese individuals. Also, methods and systems of the present invention can increase dopamine levels. As such, forced exercise can provide a reward mechanism for obese individuals following forced exercise—something these individuals are not likely to achieve on their own due to lack of fitness.

The methods have application to mammalian patients, including humans suffering from the above-described disorders. In certain embodiments, the neuromotor or neurocognitive disorders are degenerative in nature. Exemplary disorders include PD, Alzheimer's Disorder, dementia, Parkinsonian syndrome, essential tremor, multiple sclerosis (MS), amyotrophic lateral sclerosis (ALS), traumatic brain injury, stroke, multiple system atrophy (MSA), and dystonia.

In certain embodiments, the methods of the present invention lead to improvements in central nervous system motor control processes as opposed to changes in the periphery (e.g. localized changes in muscle strength of the exercised limb which may impact motor control processes). In a preferred embodiment, the methods of the present invention produce global improvements in the patient's overall motor performance (e.g. improved function of the non-exercised effectors) as measured by Unified Parkinson's Disease Rating Scale (UPDRS) ratings and manual dexterity. Further, in preferred embodiments, methods of the present invention increase the proprioceptive sensory signals to the brain and this increase in afferent feedback underlies increased cortical activation which improves motor function. Specifically, in preferred embodiments, methods of the present invention act to augment a patient's voluntary levels of neural output by increasing the quality and quantity of afferent input to the central nervous system by reducing or normalizing the altered patterns of neuronal activity in the basal ganglia-thalamo-cortical circuit.

As stated above, the forced exercise intervention can alter activation of cortical and subcortical pathways in human patients which is likely in response to the elevation of neurotrophic factors, such as brain-derived neurotrophic factors (BDNF) and glial cell line-derived neurotrophic factors (GDNF). As a result, patients can benefit from the forced exercise by achieving substantial improvement in symptoms of the neurological disorder. As an example, a given patient with a neuromotor or neurocognitive disorder such as PD may experience significant increases in manual dexterity, stroke victims may be able to achieve or significantly improve motor tasks, etc.

EXAMPLES

Example 1

Ten patients with idiopathic PD (8 men and 2 women; age 61.2±6.0 years, Table 1) were randomly assigned to complete an 8-week forced exercise (FE) or voluntary exercise (VE) intervention. Following the 8-week intervention, patients were instructed to resume their pre-enrollment activity levels; follow-up patient interviews indicated compliance with this request. Patients in the FE group exercised with a trainer on a stationary tandem bicycle (FIG. 4*a*), whereas the VE group exercised on a stationary single bicycle (Schoberer Rad Meβtechnik (SRM)). The work performed by the patient and the trainer on the tandem bicycle was measured independently with 2 commercially available power meters (SRM PowerMeter; Jülich, Germany).

TABLE 1

Group Demographics[a]

| | Forced (n = 5) | Voluntary (n = 5) | P[b] |
|---|---|---|---|
| Age (y) | 58 ± 2.1 | 64 ± 7.1 | .08 |
| Duration of PD (y) | 7.9 ± 7.0 | 4.4 ± 4.0 | .36 |
| UPDRS motor III score | | | |
| Baseline | 48.41 ± 12.7 | 49.0 ± 15.4 | .95 |
| Cadence (rpm) | 85.8 ± 0.8 | 59.8 ± 13.6 | .002 |
| Absolute power (watts) | 47 ± 16 | 67 ± 24 | .17 |
| Heart rate (bpm) | 116.8 ± 4.8 | 121.2 ± 20.5 | .65 |
| Total work (kJ) | 129.2 ± 26.2 | 149.6 ± 59.3 | .50 |
| Estimated $Vo_2$ max (mL/kg/min) | | | |
| Baseline | 26.1 ± 6.1 | 22.5 ± 2.0 | .29 |

Abbreviations:
bpm, beats per minute;
EOT, end of training;
EOT +4, 4 weeks after EOT;
kj, kilojoules;
PD, Parkinson's disease;
rpm, revolutions per minute;
UPDRS, Unified Parkinson's Disease Rating Scale.
[a]Values are mean ± standard deviation. The groups did not significantly differ from each other at baseline.
[b]P values from unpaired Student's t test statistics.

All patients completed three I-hour exercise sessions per week for 8 weeks. Each session consisted of a 10-minute warm-up, a 40-minute exercise set, and a 10-minute cool-down. The subjects were given 2- to 5-minute breaks, if needed, every 10 minutes during the 40-minute main exercise set in the initial 2 weeks of the study and were encouraged to exercise for 20 minutes at a time with a single break in later sessions. Power, heart rate, and cadence values were sampled and collected at 60 Hz.

Figure 4:
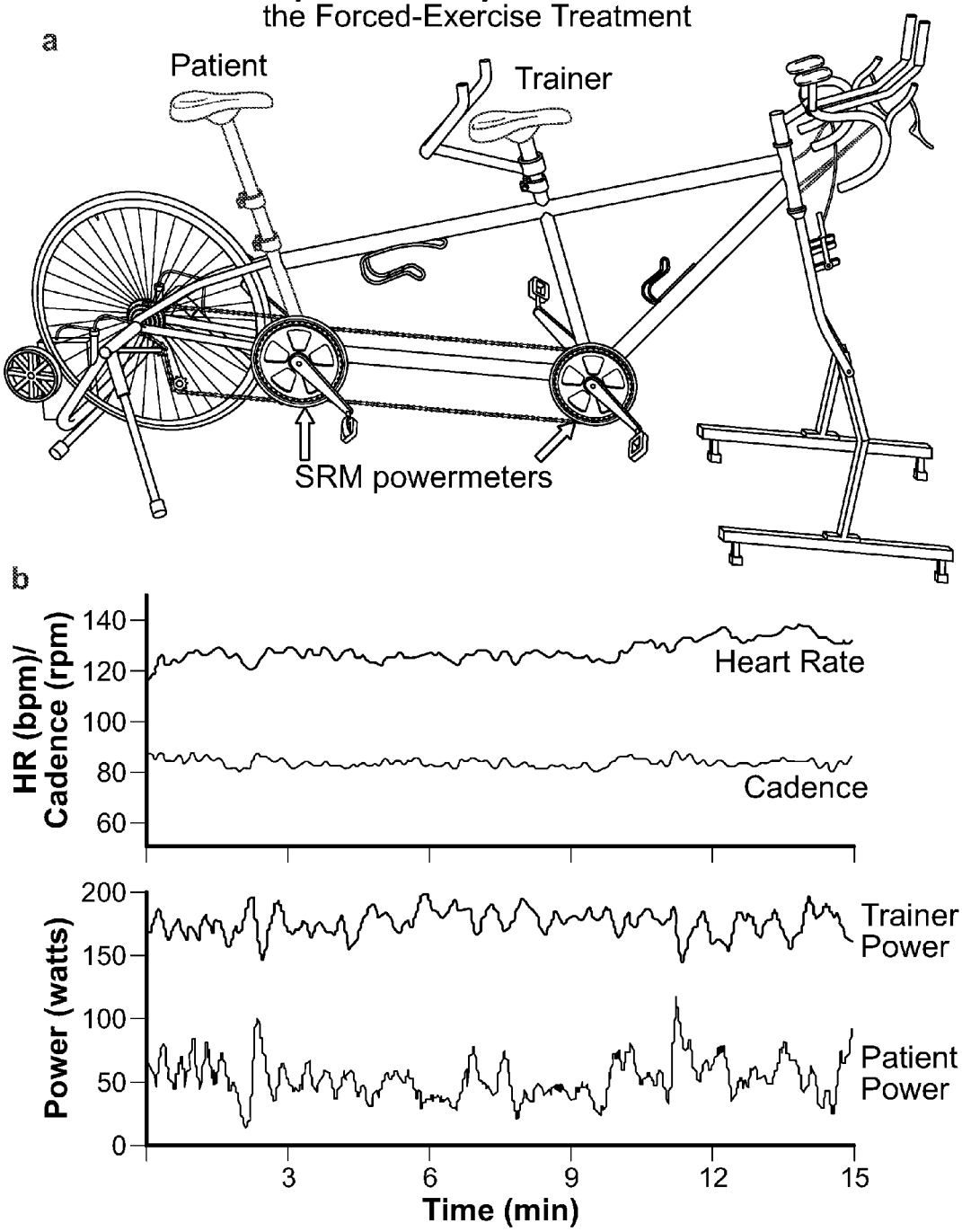
FIG. 4*a* illustrates a tandem bicycle mounted on a mechanical trainer with the front fork secured and cranksets installed at both the trainer (front) and patient (rear) positions, such as the one used in Example 1.
FIG. 4*b* shows that during a "forced exercise" ("FE") session of Example 1, the human trainer produced 175±11 watts of power and the patient produced 54±17 watts. Cadence and heart rate for the patient participants were 83.2±1.7 rpm and 128.8±5.3 bpm, respectively.

To control for any changes owing to fitness, both groups exercised at similar aerobic intensities (e.g., 60%-80% of their individualized target heart rate [$T_{HR}$]). The $T_{HR}$ was calculated using the Karnoven formula, where maximum heart rate was defined as 220 minus the patient's age. Patients in the VE group were instructed to pedal at their preferred rate and to maintain their heart rate within $T_{HR}$. Patients in the FE group were instructed to maintain their HR within their $T_{HR}$ as well. Patients in both groups were also encouraged to increase their heart rate range every 2 weeks by 5% (e.g., 60%, 65%, 70%, 75% $T_{HR}$). The FE group, assisted by an able-bodied trainer, maintained a pedaling rate between 80 and 90 revolutions per minute (rpm), or 30% more than their VE rate. The trainer modulated the resistance to ensure patients were actively engaging in pedaling, which allowed the patients to maintain $T_{HR}$. Representative training data (pedaling rate, HR, and trainer and patient power) during a 15-minute exercise block of FE are shown in FIG. 4*b*. For both groups, an exercise supervisor provided encouragement throughout each exercise session and ensured that patients maintained their heart rate within $T_{HR}$. Medications for PD remained constant throughout the study. The levodopa equivalent daily dose (LEDD) was calculated for each patient, as described previously.

A. Baseline Fitness Evaluation

The YMCA submaximal cycle ergometer test was used to estimate maximal oxygen uptake ($Vo_2$max) prior to and after the intervention. Heart rate-workload values were obtained at 4 points and extrapolated to predict workload at the estimated maximum heart rate. $Vo_2$max was then calculated from the predicted maximum workload using the formulas of Storer and colleagues. Prior to starting the test, patients cycled at a self-selected cadence and resistance for 3 minutes. This time served as a warm-up and a measure of voluntary cadence. For the test, patients pedaled the ergometer for 9 minutes (three 3-minute stages). The resistance was increased by 25 watts at each stage according to YMCA guidelines. For the analysis, average heart rate during the final 30 seconds of the second and third minutes was plotted against workload for each stage to gain an estimate of $Vo_2$max. A cool-down period of 5 minutes was performed after the test. Patients were allowed to stop the test at any time if they experienced discomfort; no patient stopped the exercise test.

B. Motor Function Evaluation

The Unified Parkinson's Disease Rating Scale (UPDRS) Part III motor exam and manual dexterity assessments were completed while patients were "off" anti-Parkinsonian medication for 12 hours. Blinded UPDRS ratings were completed by an experienced movement disorders neurologist. Assessments were performed on 35 occasions: pretreatment (baseline), after 4 weeks of treatment, end of treatment (EOT), EOT plus 2 weeks, and EOT plus 4 weeks (EOT+4). See FIGS. 5*a* and 5*b*. Manual dexterity was quantified using standard tests. The technician completing data collection was not blinded to group assignment. However, to avoid bias, the technician read an identical script to each subject explaining task requirements prior to all data collection sessions. These standard tests replicate functional manual dexterity tasks performed on a daily basis: the 2 limbs working together to separate 2 objects (similar to opening a container).

Ten trials were performed at 8 N resistance at each of the 3 evaluation time points. Interlimb coordination, as determined by the time interval between onset of grip force in manipulating and stabilizing hands and rate of grip-force production, were used to quantify bimanual dexterity. Furthermore, the center of pressure (CoP) was computed from the moment caused by the pinch force about the true origin of the transducer and the pinch force itself. The x-coordinate of the CoP was defined as the ratio of the moment in y-direction to the pinch force (i.e., force in z-direction), and the y-coordinate was defined as the ratio of the moment in x-direction to the pinch force. Additionally, principal component analysis was performed to quantify the CoP data. An ellipse that encompasses 95% of the CoP was constructed to calculate the area of the ellipse. The area of the ellipse defines the spread or the variation in the CoP data and serves as a measure of consistency of digit placement.

C. Statistical Analysis

A 2×3 (group-by-time) repeated-measures analysis of variance (ANOVA) was used to compare the group versus time (baseline, EOT, EOT+4) interaction between the variables. Post hoc multiple comparison tests were performed using the Bonferroni method, which adjusts the significance level for multiple comparisons. Student's/tests were used to compare exercise-based variables (e.g., cadence, heart rate, $Vo_2$max, work, power) and patient demographics between the FE and VE groups. All analyses were performed with SPSS 14.0 (SPSS, Inc, Chicago, Ill., 2005).

D. Results

Age, duration of PD, baseline fitness (estimated $Vo_2$max) and initial UPDRS III score while "off" anti-Parkinsonian medication were comparable between groups (Table 2). To assess workload, the total work produced during cycling was calculated; total work=power (as measured by the SRM PowerMeters)×exercise time. The total work for the FE group was then calculated for the trainer and patient individually. Patients in the FE group contributed 25% of the total work performed during pedaling, and the trainer produced the remaining 75%. The total work ($K_j$) produced by the patients and $T_{HR}$ during the exercise intervention did not differ between the groups. Average cadence during FE was significantly greater (30%) than in the VE group (Table 1, $t_8$=4.264, P=0.002). Aerobic capacity improved by 17% and 11% for the VE and FE groups, respectively; this difference between groups was not statistically significant.

Figure 5A:
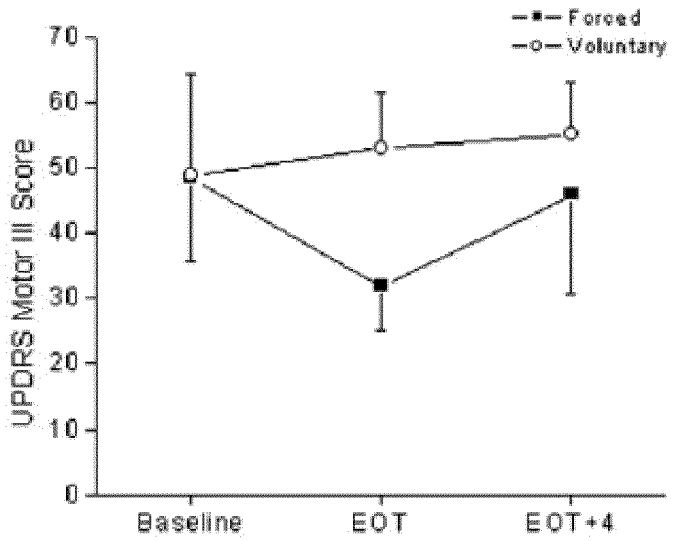
FIG. 5*a* illustrates results for Unified Parkinson's Disease Rating Scale (UPDRS) motor scores at the end of the exercise treatment ("EOT") and 4 weeks after the end of treatment ("EOT+4"), compared to a baseline score for Example 1. UPDRS scores were unchanged for patients in the "voluntary exercise" ("VE") group.
Figure 5B:
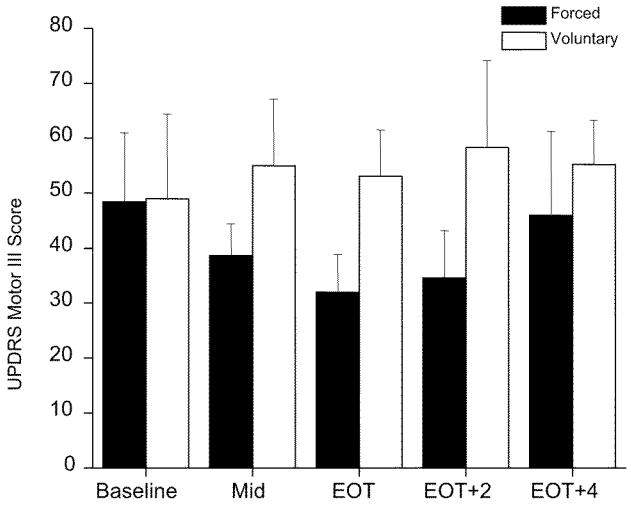
FIG. 5*b* is a bar graph illustrating UPDRS scores at additional times halfway through treatment and 2 weeks after the end of treatment for Example 1.

A significant group-by-time interaction was present for UPDRS scores ($F_{26}$=15.062, P=0.005) (Table 2, FIGS. 5*a* and 5*b*). For the FE group, UPDRS scores improved by 35% from baseline to EOT (P=0.002), whereas no improvements were observed for the VE group (P>0.17). Four weeks after exercise cessation, the UPDRS was 11% less than baseline for the FE group. The improvement at the EOT+4 evaluation for the FE group approached significance (P=0.09), and improved UPDRS at this point was present in 4 of the 5 patients in this group. In the VE group, UPDRS scores from baseline and EOT+4 were similar. Furthermore, improvements in each UPDRS motor subscale varied from patient to patient, but across the FE group, rigidity improved by 41%, tremor improved by 38%, and bradykinesia improved by 28% after 8 weeks of forced exercise (Table 3).

TABLE 2

Demographic and Total UPDRS Motor III Scores for Individual Subjects at Each Evaluation Point[a]

| Patient | Group | Age | Disease Duration (y) | H & Y | Medication (LEDD in mg) | UPDRS Baseline | UPDRS EOT | UPDRS EOT + 4 |
|---|---|---|---|---|---|---|---|---|
| 1 | FE | 58 | 5 | I-II | 200 | 45 | 28 | 53 |
| 2 | FE | 60 | 10 | II-II | 275 | 58 | 35 | 49 |
| 3 | FE | 60 | 11 | II-III | 420 | 65 | 42 | 66 |
| 4 | FE | 57 | 5 | I-II | 225 | 38 | 29 | 28 |

TABLE 2-continued

Demographic and Total UPDRS Motor III Scores for Individual Subjects at Each Evaluation Point[a]

| Patient | Group | Age | Disease Duration (y) | H & Y | Medication (LEDD in mg) | UPDRS Baseline | UPDRS EOT | UPDRS EOT + 4 |
|---|---|---|---|---|---|---|---|---|
| 5 | FE | 55 | 3 | I | 100 | 36 | 25 | 34 |
| 6 | VE | 65 | 10 | III | — | 73 | 63 | — |
| 7 | VE | 55 | 0.5 | I | 120 | 30 | 44 | 50 |
| 8 | VE | 61 | 5 | I-II | 360 | 48 | 52 | 67 |
| 9 | VE | 74 | 6 | I-II | — | 49 | 59 | 56 |
| 10 | VE | 67 | 0.5 | I-II | 470 | 45 | 45 | 49 |

Abbreviations: EOT, end of treatment: EOT +4, end of treatment plus 4 weeks; FE, forced exercise; LEDD, levodopa equivalent daily dose; VE, voluntary exercise; UPDRS, Unified Parkinson's Disease Rating Scale.

TABLE 3

Subscale Analysis of UPDRS Motor III Scores for Individual Subjects at Each Evaluation Point[a]

| Patient | Group | Rigidity Base/EOT/EOT + 4 | Tremor Base/EOT/EOT + 4 | Bradykinesia Base/EOT/EOT + 4 | Gait Base/EOT/EOT + 4 | Postural Stability Base/EOT/EOT + 4 |
|---|---|---|---|---|---|---|
| 1 | FE | 12/7/12 | 8/5/10 | 19/10/21 | 1/1/2 | 1/1/2 |
| 2 | FE | 13/6/9 | 7/4/8 | 24/18/23 | 3/2/2 | 2/1/1 |
| 3 | FE | 17/6/12 | 9/5/14 | 25/21/25 | 3/1/3 | 3/2/3 |
| 4 | FE | 9/7/9 | 6/3/1 | 16/13/15 | 1/2/1 | 0/1/1 |
| 5 | FE | 8/6/7 | 7/6/10 | 16/11/15 | 1/1/1 | 1/0/1 |
| 6 | VE | 14/14/— | 18/15/— | 28/22/— | 4/3/— | 2/3/— |
| 7 | VE | 6/10/10 | 5/7/12 | 13/22/22 | 1/1/1 | 1/1/2 |
| 8 | VE | 12/16/18 | 10/6/10 | 20/22/30 | 1/2/2 | 1/1/1 |
| 9 | VE | 8/12/11 | 9/10/10 | 22/24/24 | 3/3/2 | 2/2/2 |
| 10 | VE | 9/8/12 | 11/13/15 | 17/14/15 | 2/2/2 | 1/2/2 |

Abbreviations: base, baseline; EOT, end of treatment; EOT +4, end of treatment plus 4 weeks: FE, forced exercise; VE, voluntary exercise; UPDRS, Unified Parkinson's Disease Rating Scale.
[a]Rigidity motor score taken from item 22, tremor taken from items 20 and 21, bradykinesia taken from items 23-26 and 31, gait taken from item 29, and postural stability taken from item 30.

Figure 6:
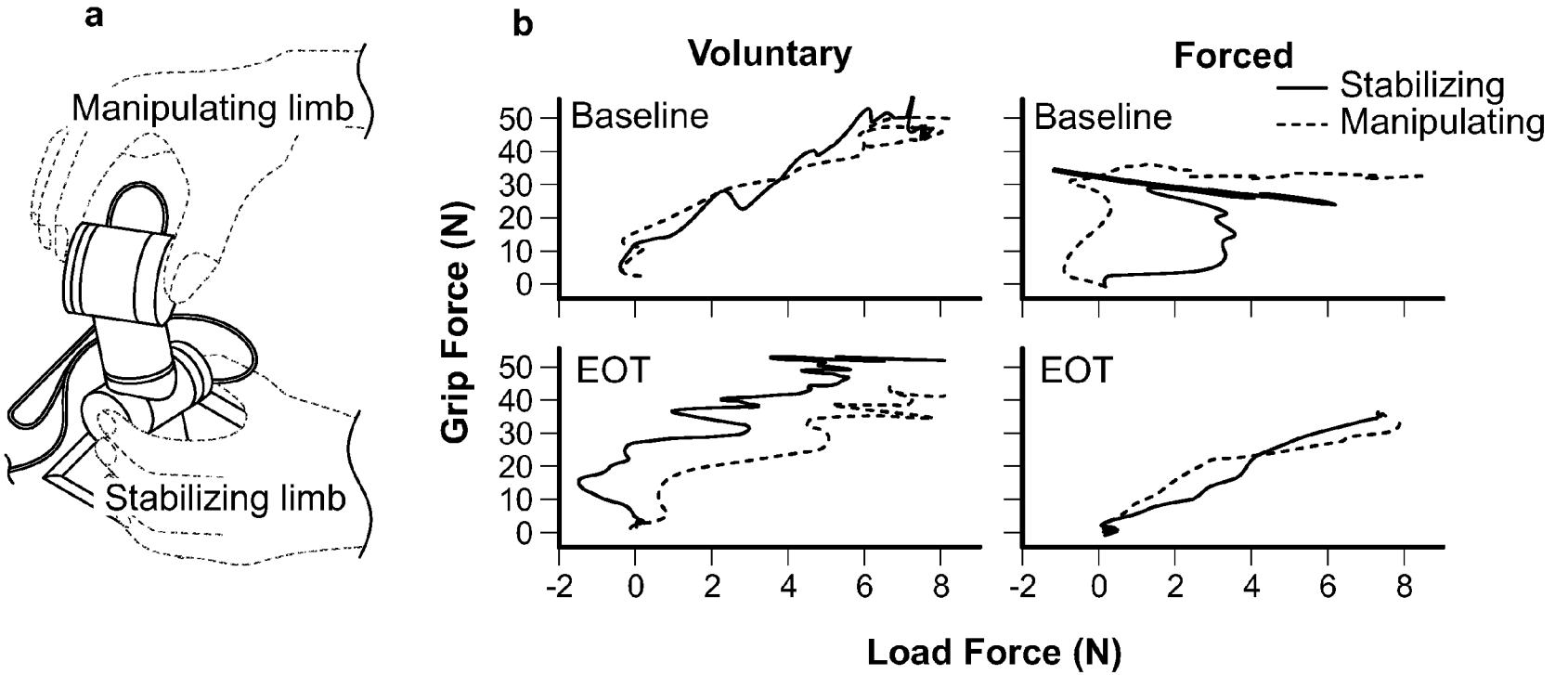
FIG. 6*a* illustrates a bimanual dexterity task.
FIG. 6*b* shows representative grip-load coordination plots for the stabilizing and manipulating limbs of the patients in the VE and FE groups for Example 1. Grip-load relationships in PD patients are typically uncoupled and irregular. After 8 weeks of exercise, grip-load relationships appear more coupled in the FE group but were unchanged after VE.
FIG. 6*c* shows mean changes in grip time delay were significantly reduced in the FE group from baseline to EOT and EOT+4. No changes in grip time delay were noted in the VE group.
FIG. 6*d* shows mean changes in rate of force production in the manipulating hand were significantly increased after 8 weeks of FE but were slightly reduced after VE.
Figure 6:
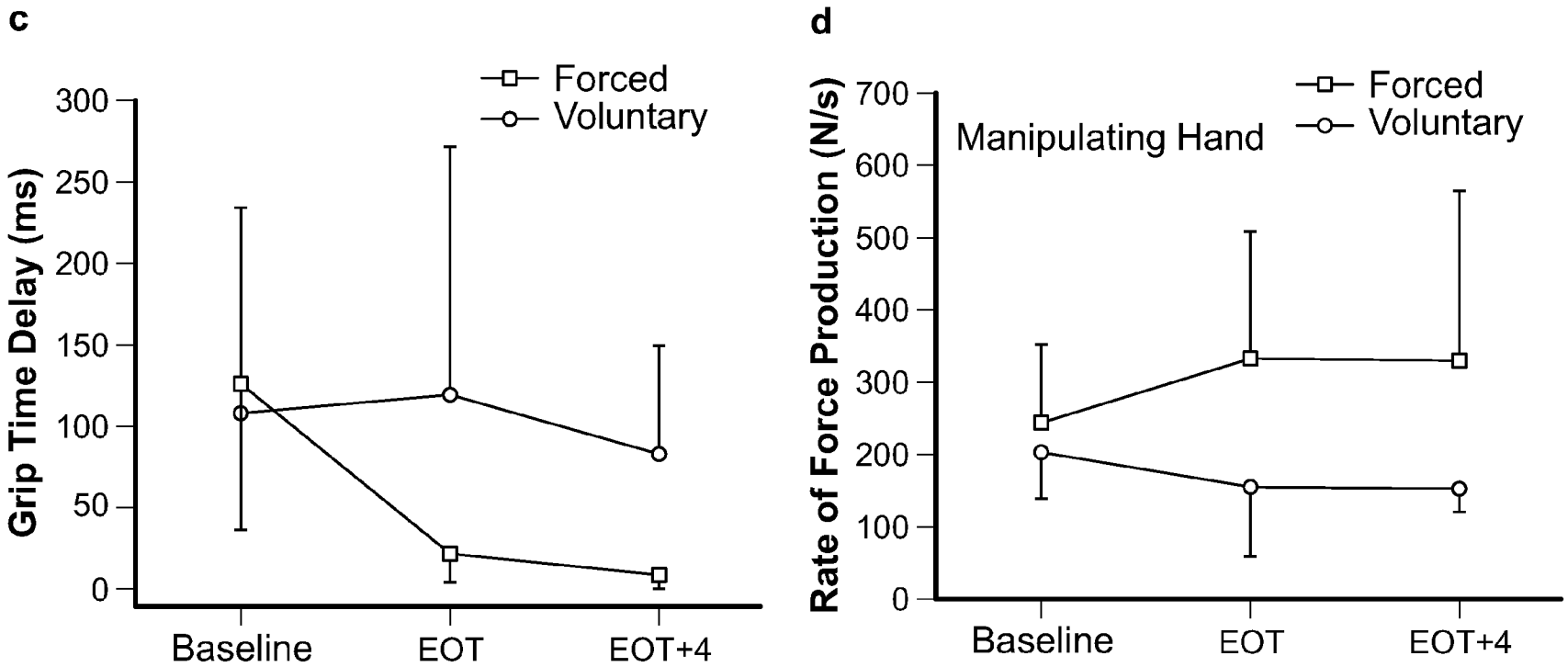

Prior to exercise, coupling of grasping forces was irregular and inconsistent in both groups (FIG. 6*a*). However following forced exercise, grip-load profile plots were more consistent and increased in a more linear fashion for both limbs. No changes in coupling of grasping forces were noted in the VE group. Interlimb coordination, as assessed by grip time delay, improved significantly for the FE group but did not change for the VE group (FIG. 6*b*; $F_{2.46}$=4.634, P=0.015). Neither group exhibited significant improvements in rate of force production for the stabilizing limb. A group-by-time interaction was present for the rate of grip force for the manipulating limb ($F_{2.36}$=6.195, P=0.005); the FE group increased the rate significantly (P=0.006), whereas a slight decrease was observed for the VE group (P=0.405; FIG. 6*c*). FIG. 6*d* shows mean changes in rate of force production in the manipulating hand were significantly increased after 8 weeks of FE but were slightly reduced after VE. Following exercise cessation, improvements in the rate of force production were maintained for the FE group, whereas the VE group did not change from baseline. These improvements in the coupling of grasping forces, interlimb coordination, and rate of force production indicate that manual dexterity was improved for patients in the FE group compared to those patients performing VE.

Figure 7:
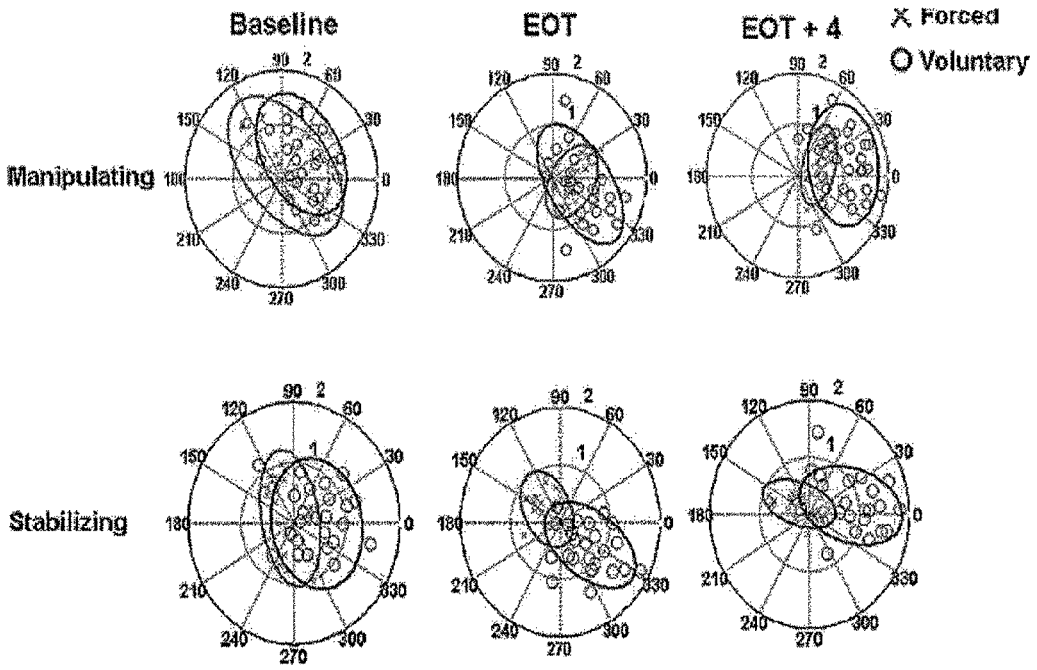
FIG. 7 illustrates center of pressure data for each trial for all patients at each evaluation point for stabilizing and manipulating limbs of Example 1.

The CoP (center of pressure) data for each trial for all patients at each evaluation point for stabilizing and manipulating limbs are provided in FIG. 7. A significant group-by-time interaction was present for area of CoP for the manipulating ($F_{2.36}$=7.85, P<0.001) and stabilizing ($F_{2.36}$=6.41, P<0.001) limbs. At baseline, patients in both groups, on average, were highly variable in digit placement for both limbs. The average area of the ellipse for the manipulating and stabilizing hand was 4.1 $cm^2$ and 3.1 $cm^2$ for the FE group, respectively, whereas the VE group had areas of 3.8 $cm^2$ and 3.1 $cm^2$ for the manipulating and stabilizing hands, respectively. In general, the VE group did not exhibit any improvement in consistency of digit placement: at EOT, 2.9 $cm^2$ and 2.8 $cm^2$ for the manipulating and stabilizing limb, respectively, and at EOT+4, 2.9 $cm^2$ and 2.5 $cm^2$. Forced exercise resulted in a significant improvement in the consistency of digit placement for both limbs. At EOT, the area of the ellipse decreased to 1.1 $mm^2$ and 1.0 $mm^2$ for the manipulating and stabilizing limbs, respectively (P<0.01 for both). These improvements were maintained at the EOT+4 week evaluation, as area was 1.74 $cm^2$ and 0.89 $cm^2$ (P<0.01 for both).

Example 1 demonstrates that 8 weeks of VE or FE improves aerobic fitness of PD patients. However, only FE produces global improvements in motor function, as evidenced by improvements in clinical ratings and biophysical measures of upper extremity dexterity. Although not statistically significant, levels of rigidity were the same or better for all patients in the FE group after exercise cessation compared to baseline rigidity. Similarly, bradykinesia was improved in 3 of the 5 patients at the EOT+4 follow-up compared to baseline levels. These clinical data suggest that the effects of FE are not transitory but may be maintained. Based on objective biophysical measures, gains in upper extremity function following FE were maintained at 4 weeks after cessation of FE.

Example 2

The effects of acute forced-exercise on brain activation pattern were studied in six mild to moderate PD patients, using a MRI protocol including whole brain MPGR anatomic images, diffusion tensor imaging and functional MRI (fMRI). For all scan sessions, patients were "off" anti-parkinsonian medication. Patients were scanned on two occasions: no-exercise and post forced-exercise. The order of these scan sessions was randomized across the six patients and scan sessions were separated by 5-7 days. On both days, patients reported to the laboratory at approximately 9:00 AM and completed UPDRS and biomechanical testing and completed familiarization trials for the motor task to be performed within the scanner. On the forced-exercise day, patients performed 40 minutes of forced-exercise (same paradigm as Example 1) and were assessed clinically with the UPDRS, blinded evaluations. Following completion of these activities patients rested and were provided a light snack. At approximately 2:00 PM, on both days, patients were transported by wheelchair to the scanner. The time between exercise completion and the onset of scanning was 3 hours.

The task performed during functional MRI examinations consisted of a tracking task, in which the patients used a precision grip (thumb and index finger only) to follow a projected sinusoidal or constant line. Patients' amount of pressure produced while squeezing a water-filled bulb was projected on the screen; patients were instructed to match their line to the constant or sinusoidal target line. The constant line corresponded to 20 percent of the patient's maximum pressure produced while squeezing and the sinusoidal line varied between 5 and 25 percent of maximum pressure, the frequency of the sine wave was 0.6 Hz. All patients performed a minimum of 50 familiarization trials for the constant and sine wave tracking outside of the scanner. Patients performed five trials for the sinusoidal and constant tracking task with each hand. Each 42 second trial was followed by an equivalent rest period. The following data were acquired for each subject in each scanning session. All subjects were scanned using a 12 channel receive-only head array on a Siemens Trio 3T scanner (Siemens Medical Solutions, Erlangen). All subjects were fitted for a bite bar to restrict head motion during scanning.

Scan 1, Whole brain T1: T1-weighted inversion recovery turboflash (MPRAGE), 120 axial slices, thickness 1-1.2 mm, Field-of-view (FOV) 256 mm×256 mm, TI/TE/TR/flip angle (FA) 900 ms/1.71 ms/1900 ms/8°, matrix 256×128, receiver bandwidth (BW) 62 kHz.

Scan 2: FMRI Activation study: 160 volumes of 31-4 mm thick axial slices are acquired using a prospective motion-controlled, gradient recalled echo, echoplanar acquisition with TE/TR/flip=29 ms/2800 ms/90°, matrix=128×128, 256 mm×256 mm FOV, receive bandwidth=125 KHz. This scan was performed four times, once for each hand in each of the two tasks described above.

The fMRI data were post-processed in the following manner: 1) Retrospective motion correction using 3 dvolreg from AFNI, 2) Spatial filtering with Hamming filter to improve functional contrast-to-noise ratio and 3) Student's t maps generated by performing a least-squares fit of the reference function (the target sine wave or constant) to the timeseries of each voxel. The derived Student's t maps were transformed into the common Talairach stereotactic space using landmarks from the anatomic scan (Scan 1).

Figure 8:
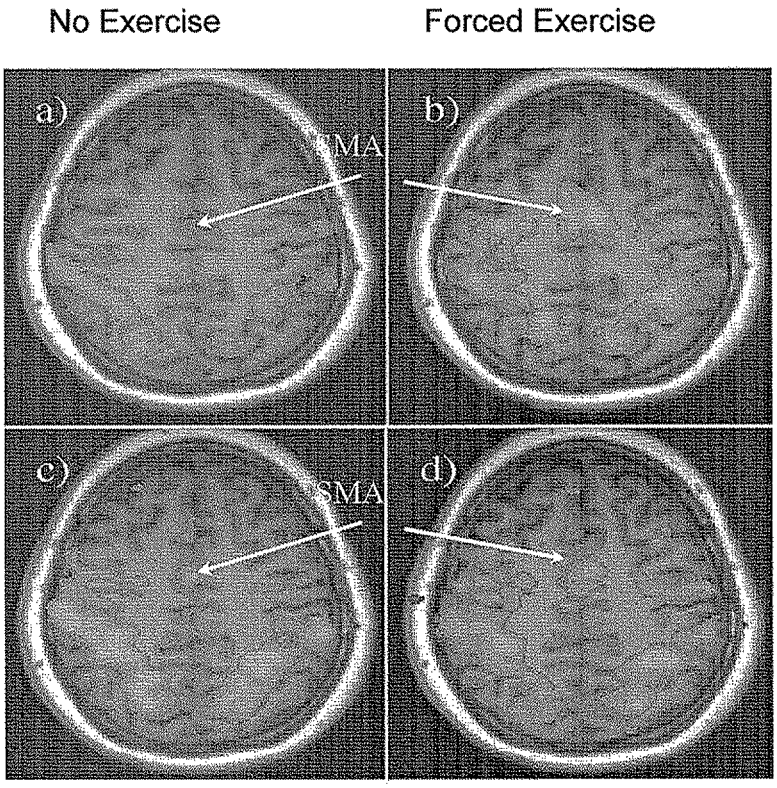
FIG. 8 shows fMRI scans of activated brain regions for Example 2 after left hand sinusoidal force task (a-b) and left hand constant force task (c-d). Maps are thresholded at $p<0.001$ (corrected).

FIG. 8 shows a single axial slice through primary and supplementary motor regions from the group averaged t-maps for activation from the left hand sinusoidal tracking paradigm (a,b) and the left hand constant tracking paradigm (c,d) for no exercise (left images) and after forced-exercise (right images). These maps indicate there is more cortical activation volume, particularly for supplementary motor areas, after forced-exercise compared to no exercise. This was a general observation across tasks performed with each limb.

Based on UPDRS ratings, motor function improved 45 percent immediately after a 40 minute forced-exercise session compared to ratings performed on the no-exercise session. Improvements for individual patients ranged from 32-53 percent. These clinical results are similar to improvements seen in Example 1. The primary outcome to assess tracking performance was the time within ±2.5% of the target line (TWR). On average, tracking performance improved (increased TWR) by 41 and 36 percent for the constant and sine-wave task respectively following forced-exercise compared to the no-exercise control condition.

Example 3

Figure 9:
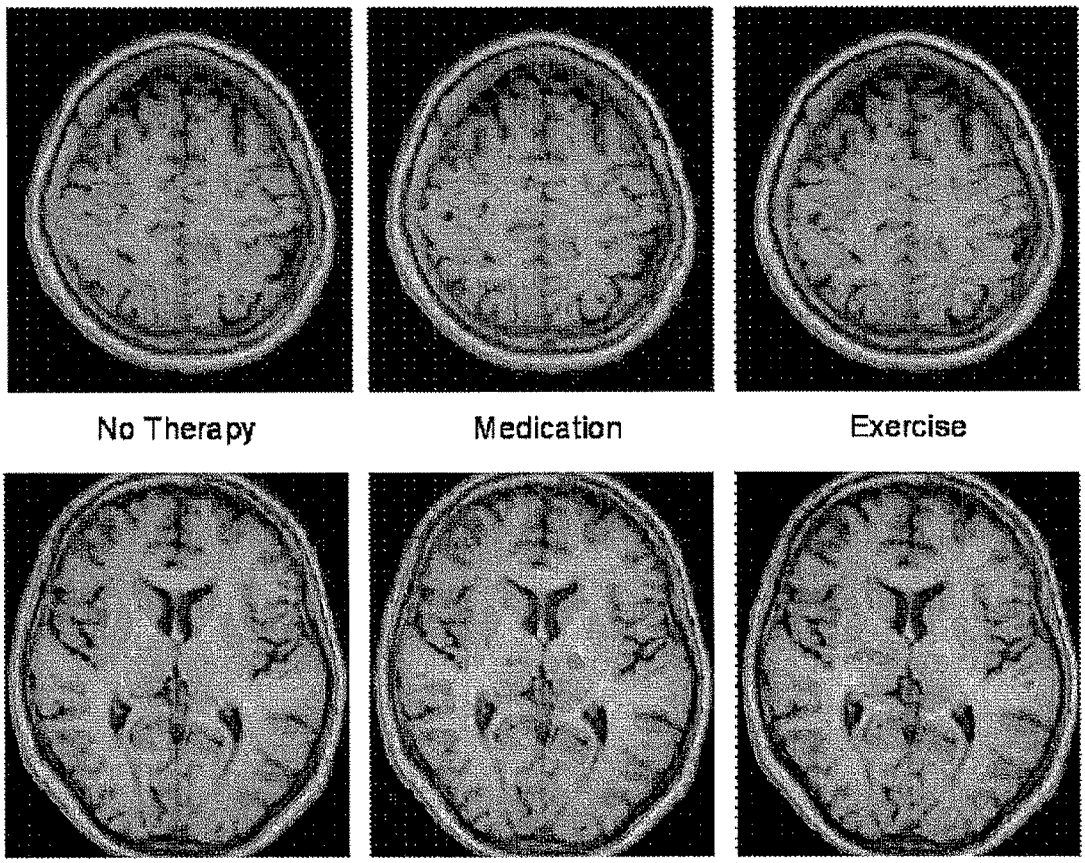
FIG. 9 shows the average fMRI data of ten patients in three different experimental groups as described in Example 3.

The average fMRI data from ten patients in three different groups (off medications, on medications, and off medications but undergoing forced exercise) under circumstances similar to those described in Example 2 is shown in FIG. 9. This fMRI data indicates activation of the supplemental motor areas of the cortex (the top images) and the basal ganglia (the bottom images) after forced exercise.

What have been described above are examples of the invention. It is, of course, not possible to describe every conceivable combination of components or methodologies for purposes of describing the invention, but one of ordinary skill in the art will recognize that many further combinations and permutations of the invention are possible. Accordingly, the invention is intended to embrace all such alterations, modifications, and variations that fall within the scope of this application, including the appended claims.

What is claimed is:

1. A forced exercise system for improving motor function in a patient exhibiting abnormal motor function, said system comprising:

an exercise machine having a movable portion that moves in response to a first contribution to movement of said movable portion by a patient;

a motor coupled to said exercise machine that provides a second contribution to said movement of said movable portion, wherein the second contribution increases a cadence of said movable portion;

at least one mechanical sensor on the exercise machine; and a control system coupled to said motor and said at least one mechanical sensor, said control system programmed to:

receive data from said at least one mechanical sensor, and alter the amount of the second contribution based on the data from said at least one mechanical sensor.

2. The system of claim 1, wherein the at least one mechanical sensor comprises a plurality of sensors that sense speed or cadence, torque generated by the patient, torque generated by the motor, and power generated by the motor.

3. The system of claim 1, wherein altering the amount of the second contribution alters a speed of the motor.

4. The system of claim 3, wherein said control system is further programmed to:

compute a patient summary score based on the data from the mechanical sensor, wherein the summary score comprises the following weighted factors:

(a) an intensity of the exercise movement, and (b) a patient contribution to the exercise movement and a motor contribution to the exercise movement; and compare the patient summary score to a predetermined desired summary score range.

5. The system of claim 4, wherein the patient summary score includes the patient contribution to the exercise movement; and wherein the weighting for the intensity, as expressed in terms of cadence rate in per minute units, is greater than the weighting for the patient contribution to the exercise movement, as expressed in terms of watts of power.

6. The system of claim 4, wherein the patient summary score includes the patient contribution to the exercise movement; and wherein the weighting for the intensity is greater than the weighting for the patient contribution to the exercise movement.

7. The system of claim 4, wherein the patient summary score includes the motor contribution to the exercise movement; and wherein the weighting for the intensity, as expressed in terms of cadence in per minute units, is greater than the weighting for the motor contribution to the exercise movement, as expressed in tenets of watts of power.

8. The system of claim 4, wherein the patient summary score includes the motor contribution to the exercise movement; and wherein the weighting for the intensity is greater than the weighting for the motor contribution to the exercise movement.

9. The system of claim 4, wherein the patient summary score includes both the patient contribution to the exercise movement and the motor contribution to the exercise movement; and wherein the weighting for the patient contribution to the exercise movement is greater than the weighting for the motor contribution to the exercise movement, as expressed in the same units of measure.

10. The system of claim 4, wherein the patient summary score includes both the patient contribution to the exercise movement and the motor contribution to the exercise movement; and wherein the weighting for the patient contribution to the exercise movement is greater than the weighting for the motor contribution to the exercise movement.

11. The system of claim 3, wherein said system further comprises a physiological sensor that senses a physiological condition of the patient indicative of aerobic activity.

12. The system of claim 4, wherein if the patient summary score is less than the predetermined desired summary score range, said control system is further programmed to:

provide instructions to said patient to increase said first contribution.

13. The system of claim 4, wherein if the patient summary score is more than the predetermined desired summary score range, said control system is further programmed to:

provide instructions to said patient to decrease said first contribution.

14. The system of claim 12, wherein if the patient does not increase the first contribution after a set time interval, said control system is further programmed to:

increase said second contribution.

15. The system of claim 1, wherein said exercise machine is one of a stationary exercise bicycle, a treadmill, a stair climber, a treadmill, a rowing machine, or a motorized bicycle.

16. The system of claim 1, wherein the neurological disorder comprises at least one of Parkinson's Disease, Alzheimer's Disease, dementia, Parkinsonian syndrome, Multiple Sclerosis, amyotrophic lateral sclerosis, dystonia, stroke, and trauma-induced brain damage.

17. A forced exercise system for improving motor function in a patient exhibiting abnormal motor function, said system comprising:

a stationary bicycle having cranks that move in response to a first contribution to movement of said cranks by a patient;

a motor coupled to said exercise machine that provides a second contribution to said movement of said cranks, wherein the second contribution increases a cadence of said cranks;

at least one mechanical sensor on the stationary bicycle; and a control system coupled to said motor and said at least one mechanical sensor, said control system programmed to:

receive data from said at least one mechanical sensor, and alter the amount of the second contribution based on the data from said at least one mechanical sensor.

* * * * *